US006601299B2

(12) United States Patent
Stikeleather

(10) Patent No.: US 6,601,299 B2
(45) Date of Patent: Aug. 5, 2003

(54) TAPERED FIN AND METHOD OF FORMING THE SAME

(75) Inventor: Allan Stikeleather, S. Easton, MA (US)

(73) Assignee: IBC Corporation, South Easton, MA (US)

( * ) Notice: Subject to any disclaimer, the term of this patent is extended or adjusted under 35 U.S.C. 154(b) by 0 days.

(21) Appl. No.: 10/032,943

(22) Filed: Oct. 19, 2001

(65) Prior Publication Data

US 2002/0104216 A1 Aug. 8, 2002

Related U.S. Application Data

(60) Provisional application No. 60/241,803, filed on Oct. 19, 2000.

(51) Int. Cl.[7] ..... B21D 53/06

(52) U.S. Cl. ..... 29/890.048; 72/136

(58) Field of Search ..... 29/890.048, 890.046, 29/890.045, 890.03; 72/136, 135, 177, 168, 167, 137; 165/184; 428/592

(56) References Cited

U.S. PATENT DOCUMENTS

| | | | | |
|---|---|---|---|---|
| 601,429 A | | 3/1898 | Caldwell | |
| 639,665 A | | 12/1899 | Commichau | |
| 805,629 A | * | 11/1905 | Caldwell | 72/136 |
| 1,216,657 A | * | 2/1917 | Cardell | 165/184 |
| 1,764,603 A | * | 6/1930 | Bell | 165/184 |
| 2,025,036 A | * | 12/1935 | Berg | 29/890.048 |
| 2,372,795 A | | 4/1945 | Rodeck | 113/118 |
| 2,440,803 A | * | 5/1948 | Lea | 165/184 |
| 2,812,794 A | | 11/1957 | Chapman | 153/7 |
| 3,112,558 A | * | 12/1963 | Nihlen et al. | 29/890.048 |
| 3,148,441 A | | 9/1964 | Schuler | 29/157.3 |
| 3,468,372 A | * | 9/1969 | Nihlen et al. | 29/890.048 |
| 4,429,558 A | | 2/1984 | Murakami et al. | 72/17 |
| 4,514,900 A | * | 5/1985 | Benard | 29/727 |
| 4,813,126 A | | 3/1989 | Williamson | 29/729 |
| 6,141,860 A | | 11/2000 | Shimahara | 29/605 |

FOREIGN PATENT DOCUMENTS

| | | | |
|---|---|---|---|
| JP | 58013410 A | * | 1/1983 |
| JP | 61001995 A | * | 1/1986 |

* cited by examiner

*Primary Examiner*—Gregory Vidovich
*Assistant Examiner*—Marc Jimenez
(74) *Attorney, Agent, or Firm*—Grossman, Tucker, Perreault & Pfleger, PLLC

(57) ABSTRACT

A method of forming an extended surface heat transfer fin by differentially rolling a metal strip having a wedge-shaped profile. The method includes linearly stretching the thicker edge of the metal strip to a greater degree than the thinner edge.

12 Claims, 1 Drawing Sheet

TAPERED FIN AND METHOD OF FORMING THE SAME

CROSS-REFERENCE TO RELATED APPLICATIONS

The present application claims the benefit of U.S. provisional application Ser. No. 60/241,803, filed on Oct. 19, 2000, the teachings of which are incorporated herein by reference.

FIELD OF THE INVENTION

This invention pertains to extended surface fins for heat exchanger tubes and a method of forming the same.

BACKGROUND OF THE INVENTION

Existing helically wound, heat exchanger fins, as may be applied to a heat exchanger tube, are typically manufactured from relatively continuous strips of non-ferrous metal having a generally rectangular cross-sectional profile. The rectangular metal strips may be differentially rolled by passing the strips through a roll mill that applies a pressure differential across the width of the metal strips. The pressure differential is commonly applied by two rolls having forming faces that are angled one relative to the other.

The differential rolling process linearly stretches the strip to differing degrees across its width to force the strip into a cambered curl configuration having a reduced thickness at its outer diameter. The inside diameter of the cambered curl is wrapped helically, standing on edge, onto the outside diameter of a round heat exchanger tube. The tube is rotated and advanced in synchronization with the differential rolling process to produce a continuous, helically finned tube.

SUMMARY OF THE INVENTION

A method of forming an extended surface heat transfer fin consistent with the invention includes use of a tapered or wedge-shaped metal strip having a thickness along one edge greater than the thickness of the strip along the other, opposing edge. The wedge-shaped strip is differentially rolled, such that the initially thicker edge of the strip is compressed more than the thin edge of the strip, resulting a greater amount of linear stretching of the strip along the thicker edge. The differential rolling process produces a cambered curl structure that may be applied to a heat transfer tube to provide a helically wrapped extended surface heat transfer fin.

DESCRIPTION OF THE DRAWINGS

For a better understanding of the present invention, together with other objects, features and advantages, reference should be made to the following detailed description which should be read in conjunction with the following figures wherein like numerals represent like parts.

DESCRIPTION OF THE INVENTION

In an exemplary embodiment, the present invention includes the use of relatively continuous, metal strip that is tapered across its width for the production of helically wrapped, extended surface heat transfer fins. The use of a tapered metal strip for producing heat transfer fins, as opposed to the conventional rectangular strip, allows for a reduction in the amount of metal required to manufacture a helically wound, extended surface heat exchanger fin. Additionally, a finished heat transfer fin consistent with the present invention may be produced having a thinner base and a more rectangular overall shape than a conventional fin. The thinner and more rectangular shape results in a decrease in air flow pressure drop through a heat exchanger, using the same number of fins per inch as the conventional helical fin tube construction due to the increased open space between the fins.

Figure 1:
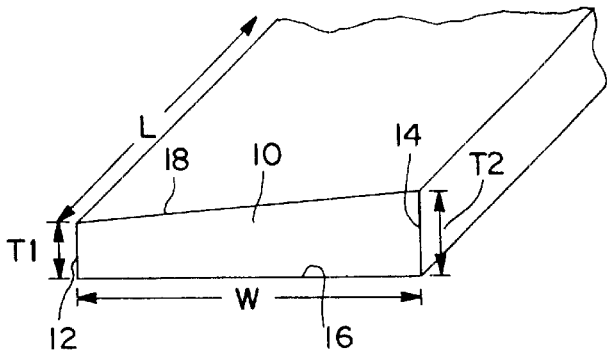
FIG. 1 is a perspective view of a portion of an exemplary tapered strip consistent with the present invention.

Referring to FIG. 1, there is illustrated a perspective view of a portion of an exemplary metal strip 10 for forming a heat transfer fin consistent with the present invention. As shown, the exemplary strip 10 is tapered across its width W, having a first thickness T1 at a first edge 12, and a second greater thickness T2 at opposed second edge 14. The width W may be generally uniform along the length L of the strip 10. In one embodiment, the aspect ratio of the width W to the thickness T2 of the second edge 14 may be 10:1 or greater.

A first side 16 of the strip 10 may be flat, i.e., generally square with each of the first edge 12 and the second edge 14. Accordingly, the tapered configuration of the strip 10 may be derived from the second side 18, which is at an angle relative to the first side 16. Alternatively, both the first side 16 and the second side 18 may be angled relative to the first edge 12 and the second edge 14. According to this alternate embodiment, the cross-sectional profile of the strip 10 may generally resemble, for example, a truncated isosceles triangle.

The metal strip 10 may be formed into a heat transfer fin by differentially rolling. In one exemplary differential rolling process, the strip 10 may be passed between two forming rolls having roll faces that are configured to compress one edge of the strip to a greater degree than the second edge. This may be accomplished, for example, by providing the roll faces such that they are angled relative to each other. Preferably, it is the second, thicker edge 14 that experiences greater compression, resulting in greater linear stretching of the strip 10 along the second edge 14. The greater linear stretching of the second edge 14 relative to the first edge 12 will form a cambered curl structure. The greater the difference in linear stretching of the second edge 14 relative to the first edge 12, the tighter the cambered curl will be, i.e., a smaller inside diameter will be produced.

Figure 2:
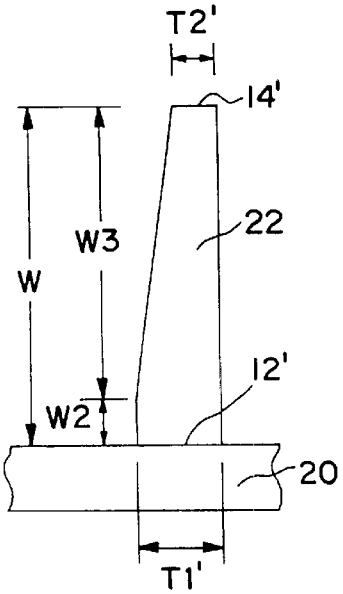
FIG. 2 is a cross-sectional view of an exemplary fin consistent with the invention disposed on a heat transfer tube.

It should be appreciated that the cross-sectional profile of the produced cambered curl is controlled, in part, by the position of the forming rolls relative to one another and the force applied to the rolls. Because the second edge 14 is thicker than the first edge 12, the strip will experience a differential rolling effect even if the forming rolls are oriented having parallel roll faces. If differential rolling is accomplished using parallel roll faces, the resultant cambered curl structure may have a rectangular cross-sectional profile. In another embodiment, the rolls may be configured to provide cross-sectional profile with a uniform thickness T1' for a width W2, and then tapering out to an outer diameter edge thickness T2' over width W3, as shown in FIG. 2. In one embodiment, the shorter width component W2 may be 0.090 inches and the longer width component W3 may be 0.547 inches.

Those skilled in the art will recognize a variety of ways in which the differentially rolled strip 10 may be applied to a heat exchanger tube to provide a heat exchanger fin. For example, after the strip 10 has been differentially rolled into a cambered curl, the cambered curl may be wrapped around a heat exchanger tube wall 20, thereby forming an extended surface heat transfer fin 22, as illustrated in FIG. 2. Preferably, however, rather than applying the strip to the heat exchanger tube as a secondary process, the strip 10 may be helically wrapped around the heat exchanger tube by rotating the tube in the inner diameter of the cambered curl and advancing it in synchronization with the differential rolling.

Figure 3:
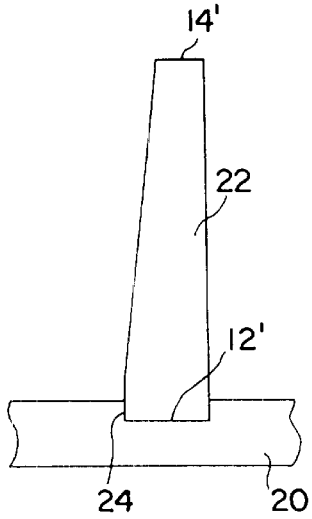
FIG. 3 is a cross-sectional view of a second exemplary fin consistent with the invention disposed on a heat transfer tube.
Figure 4:
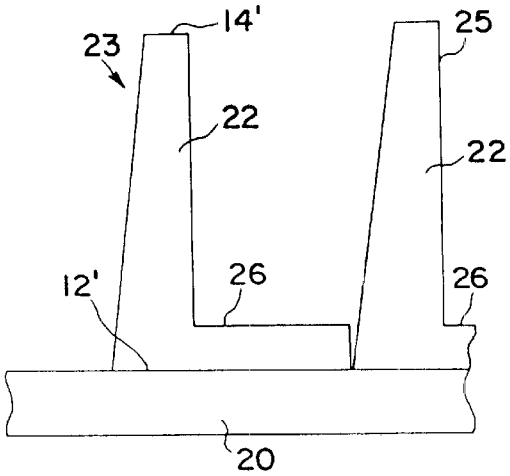
FIG. 4 is a cross-sectional view of a third exemplary fin consistent with the invention disposed on a heat transfer tube.

Also, as illustrated in FIGS. 2 through 4, a fin 22 consistent with the present invention may be secured to a tube wall 20 in a variety of manners. For example, the cambered curl may be formed to have in inside diameter that is nominally less than the outside diameter of the tube wall. The curl may thus be expanded to accept the tube in its inside diameter so that the first edge 12' of the fin 22 is simply pressingly engaged with the tube wall 20, as illustrated in FIG. 2.

In another exemplary embodiment, illustrated in cross-sectional view in FIG. 3, the first edge 12' of the heat transfer fin 22 may be disposed in a groove 24 in the tube wall 20. By disposing the first edge 12' of the heat transfer fin 22 in a groove 24, a more positive connection between the tube 20 and the heat transfer fin 22 may be achieved. In another embodiment, illustrated in FIG. 4, the heat transfer fin 22 may be provided with a foot 26. The foot 26 of the heat transfer fin 22 may generally be a region adjacent the first edge 12' that may be bent at approximately a right angle to the remainder of the fin 22. The foot 26 may extend between adjacent coils, e.g. coils 23 and 25, of the fin 22 around the tube, as shown, to provide spacing and stability for the fins.

Figure 5:
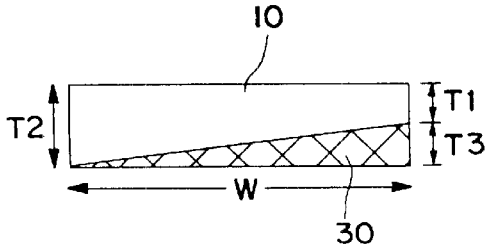
FIG. 5 is a cross-sectional view of an exemplary tapered strip superimposed on a rectangular profile.

One advantage provided by a heat transfer fin 22 formed consistent with the present invention is a metal savings compared to conventional processes. The metal savings associated with a method consistent with the invention is in proportion to the difference between the cross-sectional areas of a tapered strip 10 consistent with the present invention and the cross-sectional area of a conventional rectangular strip having a thickness equal to T2. Comparative metal savings are illustrated, for example, as triangle 30 in FIG. 5. The triangle has a base equal to the unused upper portion of the rectangular strip thickness T3 and a height equal to the corresponding width W of the strip. For example, for a tapered strip 10 having a first edge thickness T1 of 0.010 inches tapering to a second edge thickness T2 of 0.016 inches, and a width W of 0.637 inches, the metal savings over a conventional rectangular strip would be about 18%. This translates directly to reduced manufacturing cost.

Furthermore, a heat transfer fin 22 formed consistent with the present invention may exhibit the above metal savings, while still maintaining the minimum outside curl diameter thickness T2' of the fin 22 necessary to meet current industry practice. This is described with reference to the cross-sectional view of the heat transfer fin shown in FIG. 2. The first edge 12' of the fin 22 having a thickness of T1' is disposed against the tube wall 20. The second edge 14 of the initial strip 10, having an original thickness of T2, has now been differentially reduced to a new thickness T2', thereby providing the proper curl. This new thickness T2' at the second fin edge 14' represents the thickness of the outer curl diameter of the fin 22. Accordingly, a heat transfer fin 22 produced from the tapered strip 10 may have the same rolled thickness T2' at the outer diameter as a rectangular strip, while having a thinner base 12' near the tube wall 20.

For example, a tapered strip 10 of 0.637 inches width W may have a thickness T2 of 0.016 inches at the second edge 14 tapering to a thickness T1 of 0.010 inches at the first edge 12. When differentially rolled into a fin 22 for application to a one inch outside diameter (O.D.) heat transfer tube, the outside curl diameter edge 14' may have a thickness T2' of 0.0075 inches, but the opposite edge 12' may have a thickness T1' of 0.010 inches, not 0.016 inches as would be the case of a fin formed from a rectangular cross-section strip. This thinner base 12' results in a starting strip metal savings of about 18% overall while still maintaining the 0.007 inch minimum outer diameter thickness established by current industry practice. Since the finned tube product is sold by the foot, not the pound, these saving are extremely attractive an effective.

Still another advantage associated with heat transfer fins produced according to the present invention is that the reduced base thickness T1' for a given fin width W and outer diameter thickness T2', as well as the ability to produce fins 22 having a more rectangular cross-section, may result in an increase in the open space between adjacent fins along a heat transfer tube. This increase in open space between adjacent fins is achievable while still maintaining the same number of fins per inch as a conventional helical fin tube construction. The increase in open space between the fins results in a decrease in the airflow pressure drop through the heat exchanger. The decrease in airflow pressure drop correspondingly allows a decrease in fan size and/or horsepower necessary to maintain similar air flow through the heat exchanger.

Moreover, a method consistent with the invention is useful in applications where the outer diameter fin thickness must be increased beyond common industry standards to provide increased fin strength. This may occur, for example, where local conditions require helically finned heat exchangers to be cleaned by some method, such as pressure steam cleaning, that might result in bending of conventionally dimensioned fins. Use of a method consistent with the invention allows the outer diameter fin thickness to be increased while providing a smaller increase in the inner diameter fin thickness than would be required using conventional methods. Thus, increased fin strength may be achieved using less metal than required in conventional methods.

While this invention has been disclosed and illustrated with reference to particular exemplary embodiments, the principles involved are susceptible for use in numerous other embodiments that will be apparent to persons of ordinary skill in the art. The invention is, therefore, not to be limited by the exemplary embodiments described in detail hereinabove, but rather only by the claims appended hereto.

What is claimed is:

1. A method of forming an extended surface heat transfer fin comprising:

providing a metal strip having a first edge thicker than a second edge; and differentially rolling said metal strip to stretch the first edge of the strip to a greater extent than the second edge of the strip, whereby said first edge has a rolled thickness less than a rolled thickness of said second edge.

2. The method according to claim 1 further comprising helically winding the strip around a tube subsequent to differentially rolling the strip.

3. The method according to claim 2 wherein helically winding the strip comprises disposing the second edge of the strip in a helical groove in the tube.

4. The method according to claim 2 further comprising bending a portion of the strip proximate to the second edge at approximately a right angle and disposing the portion that is bent against the tube.

5. The method according to claim 1 wherein the strip has a width and the aspect ratio of the width to the first edge is equal to, or greater than, approximately 10:1.

6. The method according to claim 1 wherein the metal strip has a first side that is generally perpendicular to the first edge and the second edge.

7. The method according to claim 1 wherein differentially rolling the metal strip produces a region adjacent to the second edge having a generally constant thickness.

8. A method of forming an extended surface heat transfer fin comprising:

providing a metal strip having a first edge thicker than a second edge and an aspect ratio of a width of the strip to the first edge greater than or equal to 10:1;

differentially rolling said metal strip to stretch the first edge of the strip to a greater extent than the second edge of the strip, whereby said first edge has a rolled thickness less than a rolled thickness of said edge; and helically winding the strip around a tube.

9. The method according to claim 8 wherein helically winding the strip comprises disposing the second edge of the strip in a helical groove in the tube.

10. The method according to claim 9 further comprising bending a portion of the strip proximate to the second edge at approximately a right angle and disposing the portion that is bent against the tube.

11. The method according to claim 8 wherein the metal strip has a first side that is generally perpendicular to the first edge and the second edge.

12. The method according to claim 8 wherein differentially rolling the metal strip produces a region adjacent to the second edge having a generally constant thickness.

* * * * *

UNITED STATES PATENT AND TRADEMARK OFFICE

CERTIFICATE OF CORRECTION

PATENT NO. : 6,601,299 B2
DATED : August 5, 2003
INVENTOR(S) : Allan Stikeleather It is certified that error appears in the above-identified patent and that said Letters Patent is hereby corrected as shown below:

Column 6,
Line 4, after "said" please insert -- second --.

Signed and Sealed this

Eighteenth Day of May, 2004

JON W. DUDAS
*Acting Director of the United States Patent and Trademark Office*